US007069982B2

(12) United States Patent
Matsuzaki

(10) Patent No.: US 7,069,982 B2
(45) Date of Patent: Jul. 4, 2006

(54) HEAT TRANSFER MEMBER AND METHOD FOR MANUFACTURING SAME

(75) Inventor: Toyoaki Matsuzaki, Shizuoka-Ken (JP)

(73) Assignee: Xenesys, Inc. (JP)

( * ) Notice: Subject to any disclaimer, the term of this patent is extended or adjusted under 35 U.S.C. 154(b) by 0 days.

(21) Appl. No.: 10/998,734

(22) Filed: Nov. 30, 2004

(65) Prior Publication Data

US 2005/0150644 A1 Jul. 14, 2005

Related U.S. Application Data

(62) Division of application No. 10/156,007, filed on May 29, 2002.

(30) Foreign Application Priority Data

Aug. 6, 2001 (JP) ..... 2001-237450

(51) Int. Cl.
*F28F 3/04* (2006.01)

(52) U.S. Cl. ..... 165/166; 165/165

(58) Field of Classification Search ..... 165/165, 165/166

See application file for complete search history.

(56) References Cited

U.S. PATENT DOCUMENTS 3,286,999 A 11/1966 Zenyu
3,298,432 A 1/1967 Przyborowski
3,554,273 A 1/1971 Kritzer
5,413,872 A 5/1995 Faigle
5,474,832 A 12/1995 Massey
5,944,094 A 8/1999 Bugler, III et al.

FOREIGN PATENT DOCUMENTS

EP 1 085 286 A 3/2001
FR 998 449 1/1952

*Primary Examiner*—Leonard R. Leo
(74) *Attorney, Agent, or Firm*—Rader, Fishman & Grauer PLLC

(57) ABSTRACT

A heat transfer member for a heat exchanger, is press-formed of a metallic thin sheet material into a prescribed shape by means of molds of a press forming device so that the heat transfer member has on at least one portion thereof a heat transfer face having opposite surfaces, which are to be brought into contact with heat exchange fluids, respectively. The heat transfer face comprises at least one set of irregularity patterns arranged in a row. Each of the at least one set of irregularity pattern units comprises (i) a central pattern portion having a plurality of recesses or projections provided with a prescribed pitch, (ii) a pair of heat exchanging irregularity pattern portions provided on opposite sides of the central pattern portion so as to be symmetrical with respect to the central pattern portion and (iii) at least one boundary pattern portion provided on at least one of respective outer sides of the pair of heat exchanging irregularity pattern portions so as to be adjacent to the respective outer sides thereof. The boundary pattern portion has a prescribed width and a plurality of recesses or projections provided with a same pitch as the plurality of recesses or projections of the central pattern portion so as to be in parallel therewith.

3 Claims, 10 Drawing Sheets

HEAT TRANSFER MEMBER AND METHOD FOR MANUFACTURING SAME

CROSS REFERENCE TO RELATED APPLICATIONS

The present application is a Divisional Application of the patent application Ser. No. 10/156,007, filed on May 29, 2002, which is based on Japanese Priority Document JP2001-237450, filed in the Japanese Patent Office on Aug. 6, 2001, the entire contents of which are incorporated herein by reference.

BACKGROUND OF THE INVENTION

1. Field of the Invention

The present invention relates a heat transfer member for a heat exchanger, which is obtained by press-forming material to be worked, on the one hand, and a method for manufacturing such a heat transfer member, on the other hand, and especially to the heat transfer member in which a plurality of press-formed portions having a prescribed shape are arranged, on the one hand, and the method for manufacturing same, by which the press-formed portions can be formed on the material to be worked in an appropriate arrangement.

2. Description of the Related Art

If there is a wish that heat transfer coefficient is increased to enhance heat exchange effectiveness, utilizing a heat exchanger by which heat exchange is made between a high temperature fluid and a low temperature fluid, a plate-type exchanger has conventionally been used widely. The plate-type exchanger has a structure in which a plurality of heat transfer members having a plate-shape are placed parallelly one upon another at prescribed intervals so as to form passages, which are separated by means of the respective heat transfer member. A high temperature fluid and a low temperature fluid flow alternately in the above-mentioned passages to make heat exchange through the respective heat transfer members.

Such a heat transfer member, which has patterns of irregularity, is usually formed of a metallic thin sheet. The heat transfer member can be manufactured by a press-forming method utilizing a press-forming device and put into practical use. A set of forming molds has conventionally been used in order to form the heat transfer member. More specifically, a metallic thin sheet serving as material to be worked is placed between the set of molds so that relative movement of the molds form the heat transfer member having a prescribed shape such as a heat transfer face on the metallic sheet.

The conventional heat transfer member having the above-described structure causes a problem of making deformation of the heat transfer member thorough pressure of fluids to bring the adjacent heat transfer members into contact with each other, when the distance between the adjacent heat transfer members is extremely small and there exists a large pressure difference between a high pressure fluid and a low pressure fluid, which flow along the opposite surfaces of the heat transfer member. Such a problem leads to improper change in distance between the adjacent heat transfer members and damage to the heat transfer face, thus causing possibility that effective heat exchange may not be performed.

The heat transfer face of the heat transfer member has a pattern of irregularity with various shapes in order to improve heat transfer effectiveness and condensation property. When the heat transfer face has a non-uniform pattern, in which the pitch of the irregularity becomes small on the one end of the heat transfer face and large on the other end thereof, degree of drawing of material from a non-press formed portion into a press-formed portion in the press formation varies depending upon a position of pattern of irregularity. A remarkable residual distortion exists in the pressed portion and the non-pressed portion of the heat transfer member after completion of the press formation, thus causing problems of warp of a part or entirety of the heat transfer member and deformation thereof.

SUMMARY OF THE INVENTION

An object of the present invention, which was made to solve the above-mentioned problems, is therefore to provide a heat transfer member in which prescribed press-formed portions are formed in addition to a pattern of irregularity serving as the heat transfer face so as to prevent abnormal deformation and maintain a proper distance between the adjacent heat transfer members, thus making a reliable heat exchange, on the one hand, and a method for manufacturing such a heat transfer member, on the other hand.

In order to attain the aforementioned object, a heat transfer member of the first aspect of the present invention for a heat exchanger, which is press-formed of a metallic thin sheet material into a prescribed shape by means of molds of a press forming device so that said heat transfer member has on at least one portion thereof a heat transfer face having opposite surfaces, which are to be brought into contact with heat exchange fluids, respectively, wherein:

said heat transfer face comprises at least one set of irregularity patterns arranged in a row, each of said at least one set of irregularity pattern units comprising (i) a central pattern portion having a plurality of recesses or projections provided with a prescribed pitch, (ii) a pair of heat exchanging irregularity pattern portions provided on opposite sides of said central pattern portion so as to be symmetrical with respect to said central pattern portion and (iii) at least one boundary pattern portion provided on at least one of respective outer sides of said pair of heat exchanging irregularity pattern portions so as to be adjacent to the respective outer sides thereof, said at lest one boundary pattern portions having a prescribed width and a plurality of recesses or projections provided with a same pitch as said plurality of recesses or projections of said central pattern portion so as to be in parallel therewith.

According to the first aspect of the present invention, there is formed a single set or a plurality of sets of press-formed portion comprising the central pattern portion having the plurality of recesses or projections, the pair of heat exchanging irregularity pattern portions provided on the opposite sides of the central pattern portion so as to be symmetrical with respect to the central pattern portion and the at least one boundary pattern portion having the plurality of recesses or projections, which is provided on the at least one of the respective outer sides of the pair of heat exchanging irregularity pattern portions, so that the whole of the central pattern portion, the heat exchanging irregularity pattern portions and the boundary pattern portion serves as the single heat transfer face. When the heat transfer member is placed on the other heat transfer member so that the inner surfaces of them face each other and the latter is positioned upside down, the projections of the central pattern portion and the projections of the boundary pattern portion of the one heat transfer member come into close contact with those of the other heat transfer member, respectively. It is therefore possible to maintain a constant distance between the heat transfer members, thus coping with a case where there is a large difference in pressure between the heat transfer fluids. Accordingly, a uniform heat exchange property can be provided and a reliable strength of the whole heat exchanger, which is composed of the combined heat transfer members, can be obtained. Even when the heat exchanging irregularity pattern portion has a non-uniform pattern in the vertical direction of the heat transfer face, the boundary pattern portions having the uniform pattern, are disposed outside the heat exchanging irregularity pattern portion, so as to reduce residual distortion after completion of the press formation, preventing abnormal deformation of the respective portions of the heat transfer member.

In order to attain the aforementioned object, a heat transfer member of the second aspect of the present invention for a heat exchanger, is press-formed of a metallic thin sheet material into a prescribed shape by means of molds of a press forming device so that said heat transfer member has on at least one portion thereof a heat transfer face having opposite surfaces, which are to be brought into contact with heat exchange fluids, respectively, wherein:

said heat transfer face comprises at least one set of irregularity patterns arranged in a row, each of said at least one set of irregularity pattern units comprising (i) a central pattern portion having a plurality of recesses or projections provided with a prescribed pitch, said central portion having two pairs of opposite sides, (ii) a pair of heat exchanging irregularity pattern portions provided on one of said two pairs of opposite sides of said central pattern portion so as to be symmetrical with respect to said central pattern portion, said pair of heat exchanging irregularity pattern portions and said central pattern forming a pair of opposite connection sides extending along an other of said two pairs of opposite sides of said central pattern portion, and (iii) at least one boundary pattern portion provided on at least one of said pair of opposite connection sides, said at least one boundary pattern portion having a prescribed width and a plurality of recesses or projections with a prescribed pitch so as to be perpendicular to said plurality of recesses or projections of said central pattern portion.

According to the second aspect of the present invention, there is formed a single set of a plurality of sets of press-formed portion comprising the central pattern portion having the plurality of recesses or projections, the pair of heat exchanging irregularity pattern portions provided on the opposite sides of the central pattern portion so as to be symmetrical with respect to the central pattern portion and the at least one boundary pattern portion having the plurality of recesses or projections, which is provided on the at least one of the pair of opposite connection sides. The at least one boundary pattern portion has the prescribed width and the plurality of recesses or projections with a prescribed pitch so as to be perpendicular to the recesses or projections of the central pattern portion. When the heat transfer member is placed on the other heat transfer member so that the inner surfaces of them face each other and the latter is positioned upside down, the projections of the central pattern portion and the projections of the boundary pattern portion of the one heat transfer member come into close contact with those of the other heat transfer member, respectively. It is therefore possible to maintain a constant distance between the heat transfer members, thus coping with a case where there is large difference between the heat transfer fluids. Accordingly, a uniform heat exchange property can be provided and a reliable strength of the whole heat exchanger, which is composed of the combined heat transfer members, can be obtained. Even when the central pattern portion and the heat exchanging irregularity pattern portion have a non-uniform pattern in the horizontal direction of the heat transfer face, the boundary pattern portions having the uniform pattern, are disposed on the adjacent portions, so as to reduce residual distortion after completion of the press formation, preventing abnormal deformation of the respective portions of the heat transfer member.

In the third aspect of the present invention, said boundary pattern portion may continue in a form of grooves or projections in a direction perpendicular a direction of said plurality of recesses or projections thereof so as to form a plurality of rows of irregularities, providing a smooth wave-shaped cross section.

According to the third aspect of the present invention, the boundary pattern portion continues in a form of grooves or projections in the perpendicular direction to the plurality of recesses or projections thereof so as to form a plurality of rows of irregularities, providing the smooth wave-shaped cross section. When the heat transfer member is placed on the other heat transfer member so that the inner surfaces of them face each other and the latter is positioned upside down, the respective projections of the boundary pattern portions come into contact with each other. The number of contact points of the boundary pattern portions can be reduced, thus minimizing the contact areas of the boundary pattern portions so as to ensure a gap communicating with the boundary pattern portion. Accordingly, when the heat transfer member serves as a condenser, smooth flow of the heat exchange fluid in liquid phase can be ensured without causing buildup, thus enhancing the heat exchange effectiveness in the heat transfer face. The recesses or projections of the smooth wave-shaped cross section improve formability of the boundary pattern portions, thus avoiding defects of the products.

In the fourth aspect of the present invention, said central pattern portion or said boundary pattern portion may continue in a form of grooves or projections in a direction of said plurality of recesses or projections thereof so as to form a plurality of rows of irregularities, providing a smooth wave-shaped cross section.

According to the fourth aspect of the present invention, the central pattern portion or the boundary pattern portion continues in the form of grooves or projections in the direction of the plurality of recesses or projections thereof so as to form the plurality of rows of irregularities, providing the smooth wave-shaped cross section. When the heat transfer member is placed on the other heat transfer member so that the inner surfaces of them face each other and the latter is positioned upside down, the respective projections of the boundary pattern portions come into contact with each other. The number of contact points of the boundary pattern portions can be reduced, thus minimizing the contact areas of the boundary pattern portions so as to ensure a gap communicating with the boundary pattern portion. Accordingly, when the heat transfer member serves as a condenser, smooth flow of the heat exchange fluid in liquid phase can be ensured without causing buildup, thus enhancing the heat exchange effectiveness in the heat transfer face. The recesses or projections of the smooth wave-shaped cross section improve formability of the boundary pattern portions, thus avoiding defects of the products.

In order to attain the aforementioned object, a method of the fifth aspect of the present invention for manufacturing a heat transfer member, comprises the step of:

subjecting a material to be worked, which is made of a metallic thin sheet, to a press forming utilizing a press-forming device, while feeding said material to be worked in a single feeding direction, to form a heat transfer member for a heat exchanger, said heat transfer member having a prescribed shape, said heat transfer member having on at least one portion thereof a heat transfer face that has opposite surfaces, which are to be come into contact with heat exchange fluids, respectively, wherein:

said press-forming device comprises a main mold for forming the heat transfer face, said main mold having prescribed patterns of irregularity, which are placed in prescribed front and rear zones in the feeding direction of the material to be worked so as to be symmetrical to each other with respect to a central position between said front and rear zones and be in an equal positional relationship relative to said central position in a perpendicular direction to said feeding direction of said material to be worked;

said material to be worked is press-formed by means of said main mold of said press-forming device so that at least one set of press-formed portions are placed without forming a gap therebetween, thereby forming the heat transfer member.

According to the fifth aspect of the present invention, the material to be worked is press-formed by means of the press-forming device, which comprises the main mold having the prescribed patterns of irregularity, which are placed in the front and rear zones in the feeding direction of the material to be worked so as to be symmetrical to each other so that a single press-forming operation of the press-forming device provides the press-formed portions in the above-mentioned front and rear zones, which have the patterns of irregularity in an equal positional relationship relative to the central position in the perpendicular direction to the feeding direction of the material to be worked. Accordingly, it is possible to provide a substantially uniform forming condition in the prescribed regions of the press-formed portions, which are adjacent to the non-pressed portions of the material to be worked, irrespective of a shape of the intermediate portion of the main mold in the feeding direction. Degree of drawing of the material to be worked from the non-pressed portion into the press-formed portion in the press formation therefore becomes substantially uniform in the boundary position between the press-formed portion and the non-pressed portion. The residual distortion can be prevented from occurring on the press-formed portion and the non-pressed portion, after completion of the press formation, thus avoiding abnormal deformation of the heat transfer member finally obtained.

In the sixth aspect of the present invention, the patterns of irregularity of the main mold of said press-forming device, which are placed in the front and rear zones in the feeding direction of the material to be worked, may be identical to each other; and of the press-formed portions of the material to be worked, which have been formed utilizing said press-forming device, the press-formed portion having the pattern of irregularity, which is placed on a side of the rear zone in said feeding direction, may be subjected to a re-pressing step utilizing the pattern of irregularity, which is placed on a side of the front zone in said feeding direction in said main mold, while intermittently feeding said material to be worked by a prescribed length, thereby forming the sets of press-formed portions on the material to be worked.

According to the sixth aspect of the present invention, the patterns of irregularity of the main mold of the press-forming device, which are placed in the front and rear zones in the feeding direction of the material to be worked, are identical to each other. Of the press-formed portions of the material to be worked, which have been formed utilizing the press-forming device, the press-formed portion having the pattern of irregularity, which is placed on the side of the rear zone in the feeding direction, is subjected to the re-pressing step utilizing the pattern of irregularity, which is placed on the side of the front zone in the feeding direction in the main mold. As a result, a dual-pressing operation is carried out in the front and rear zones in the feeding direction of the material to be worked so as to hold a part of the press-formed portion through the re-pressing step, thus controlling movement of material from the press-formed portion into the portion to be newly press-formed. It is therefore possible to prevent occurrence of distortion due to the press-forming step, thus reducing residual distortion in the press-formed portion and the non-pressed portion, after completion of the press formation and avoiding abnormal deformation of the heat transfer member finally obtained. In addition, the dual-pressing operation, applied to the press-formed portion of the heat transfer member, based on the patterns of irregularity maximizes the effective operative portions serving as the heat transfer face, while preventing deformation of the press-formed portion.

DETAILED DESCRIPTION OF THE PREFERRED EMBODIMENTS

Now, the embodiment of the present invention will be described in detail below with reference to FIGS. 1 to 9.

Figure 1:
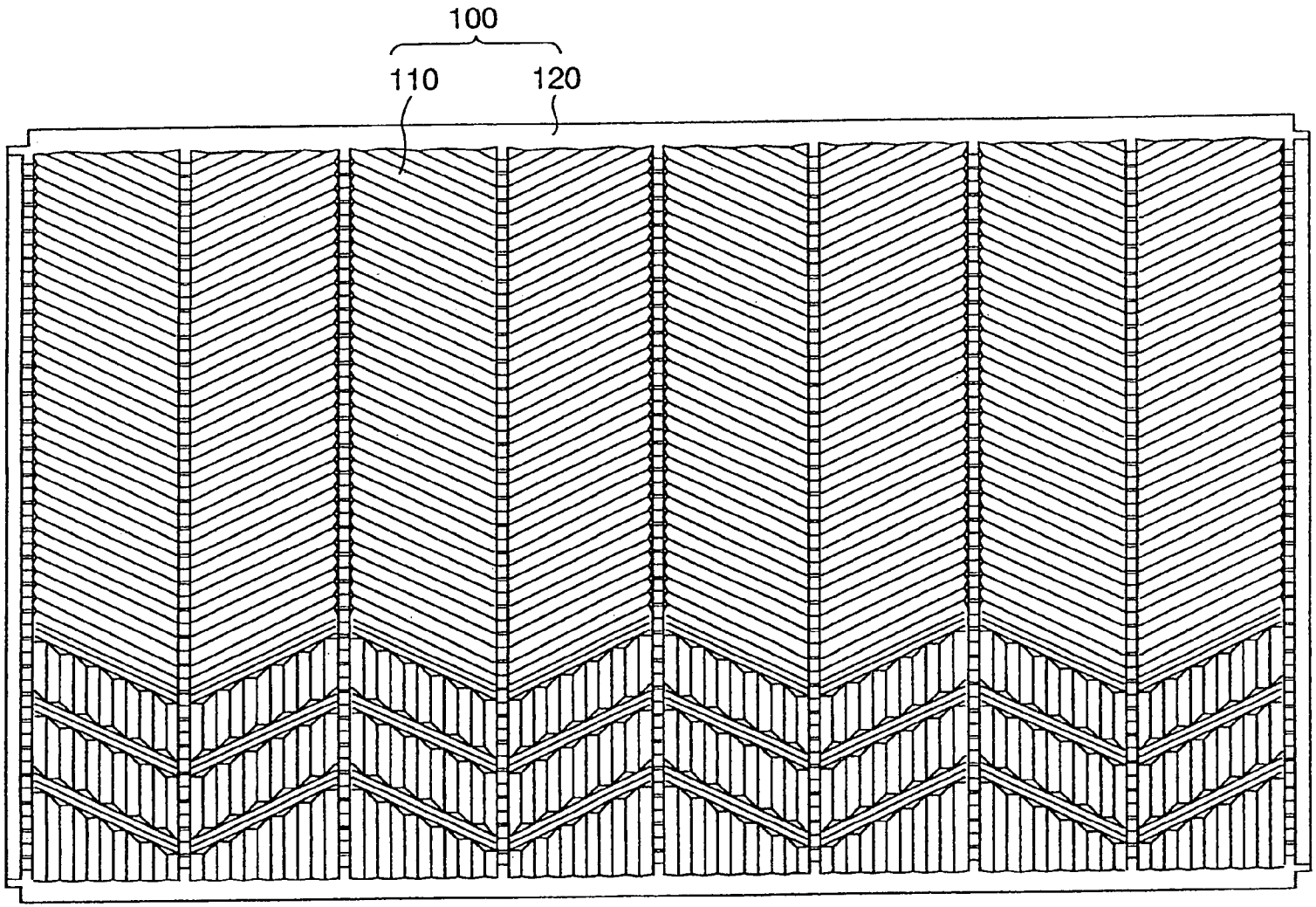
FIG. 1 is a front view illustrating a heat transfer member in accordance with the embodiment of the present invention.
Figure 2:
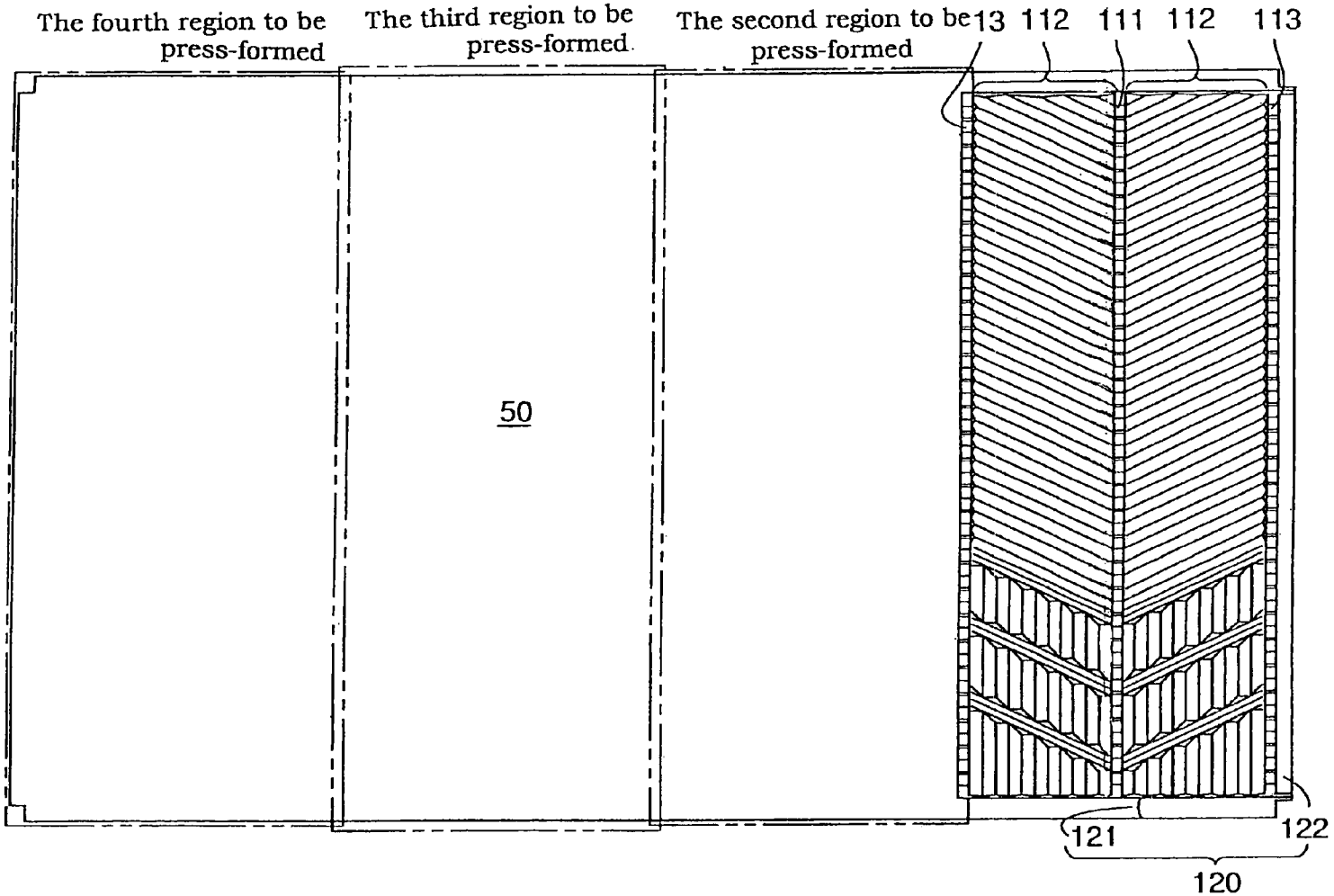
FIG. 2 is a descriptive view illustrating a state in which the press-forming step is being carried out in accordance with the embodiment of the present invention.
Figure 3A:
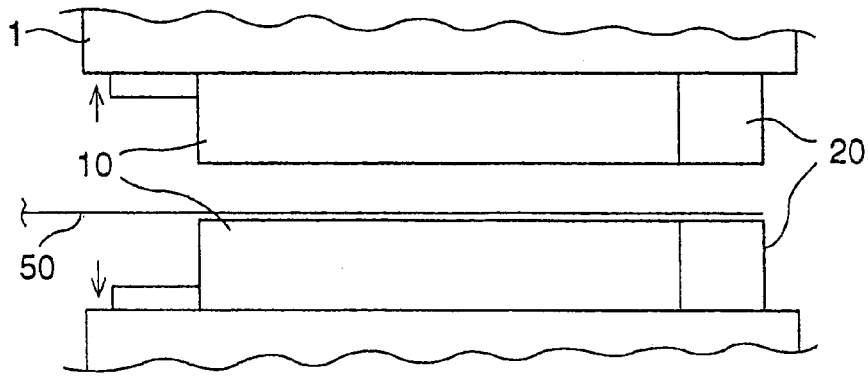
FIG. 3, consisting of FIGS. 3A and 3B, is a descriptive view of a press-forming operation, which is applied to one end of the material to be worked in accordance with the embodiment of the method of the present invention for manufacturing the heat transfer member.
Figure 3B:
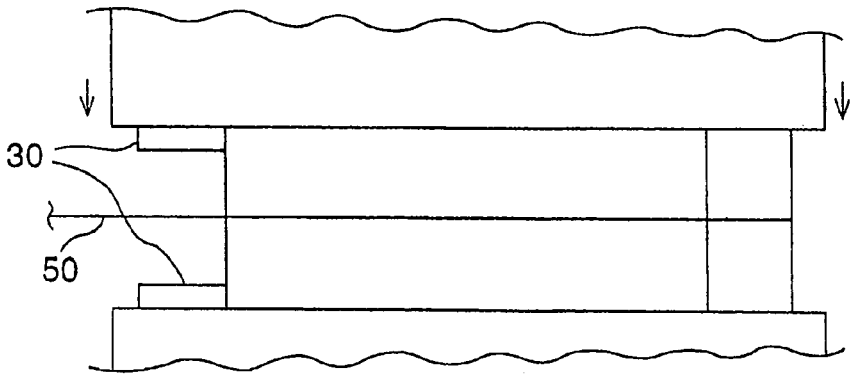
Figure 4A:
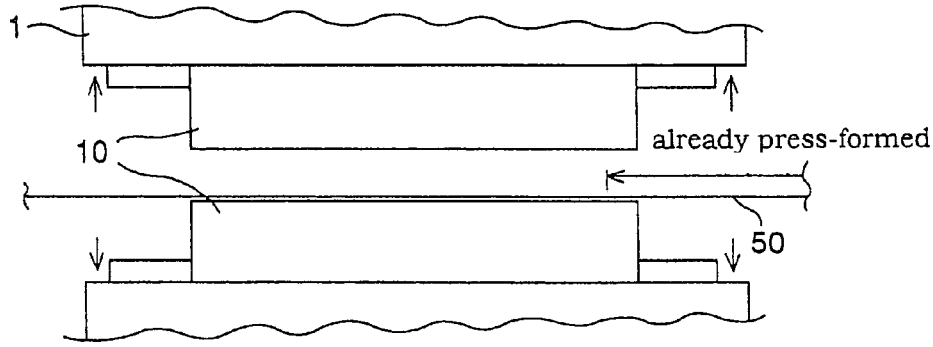
FIG. 4, consisting of FIGS. 4A and 4B, is a descriptive view of a press-forming operation, which is applied to the intermediate portion of the material to be worked in accordance with the embodiment of the method of the present invention for manufacturing the heat transfer member.
Figure 4B:
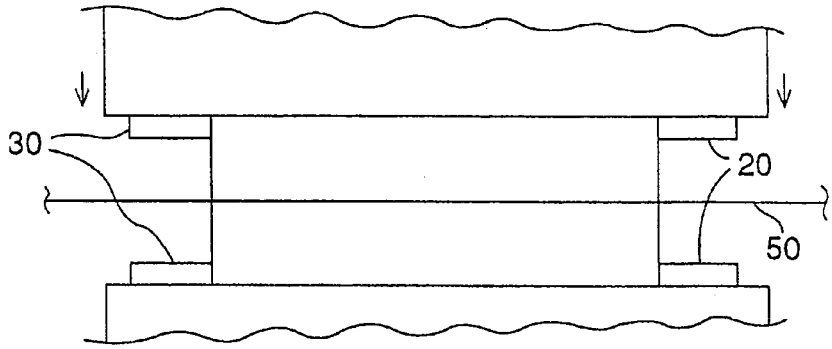
Figure 5A:
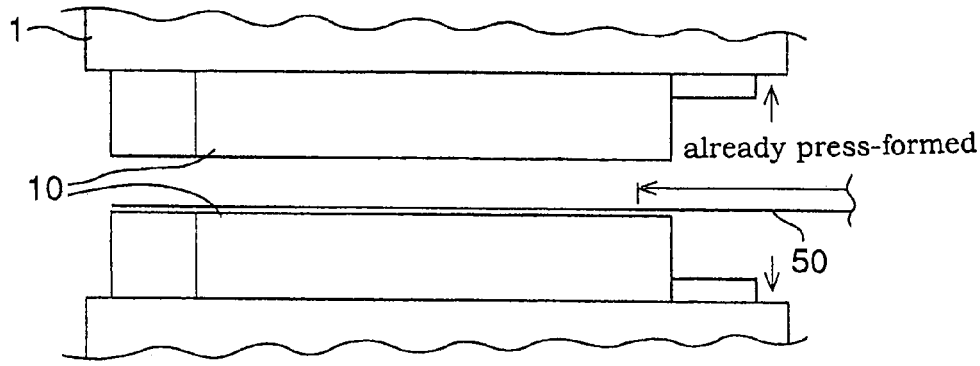
FIG. 5, consisting of FIGS. 5A and 5B, is a descriptive view of a press-forming operation, which is applied to the other end of the material to be worked in accordance with the embodiment of the method of the present invention for manufacturing the heat transfer member.
Figure 5B:
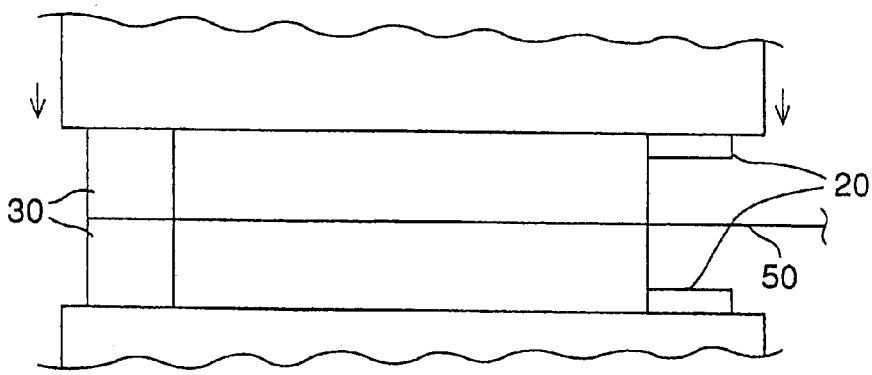
Figure 6:
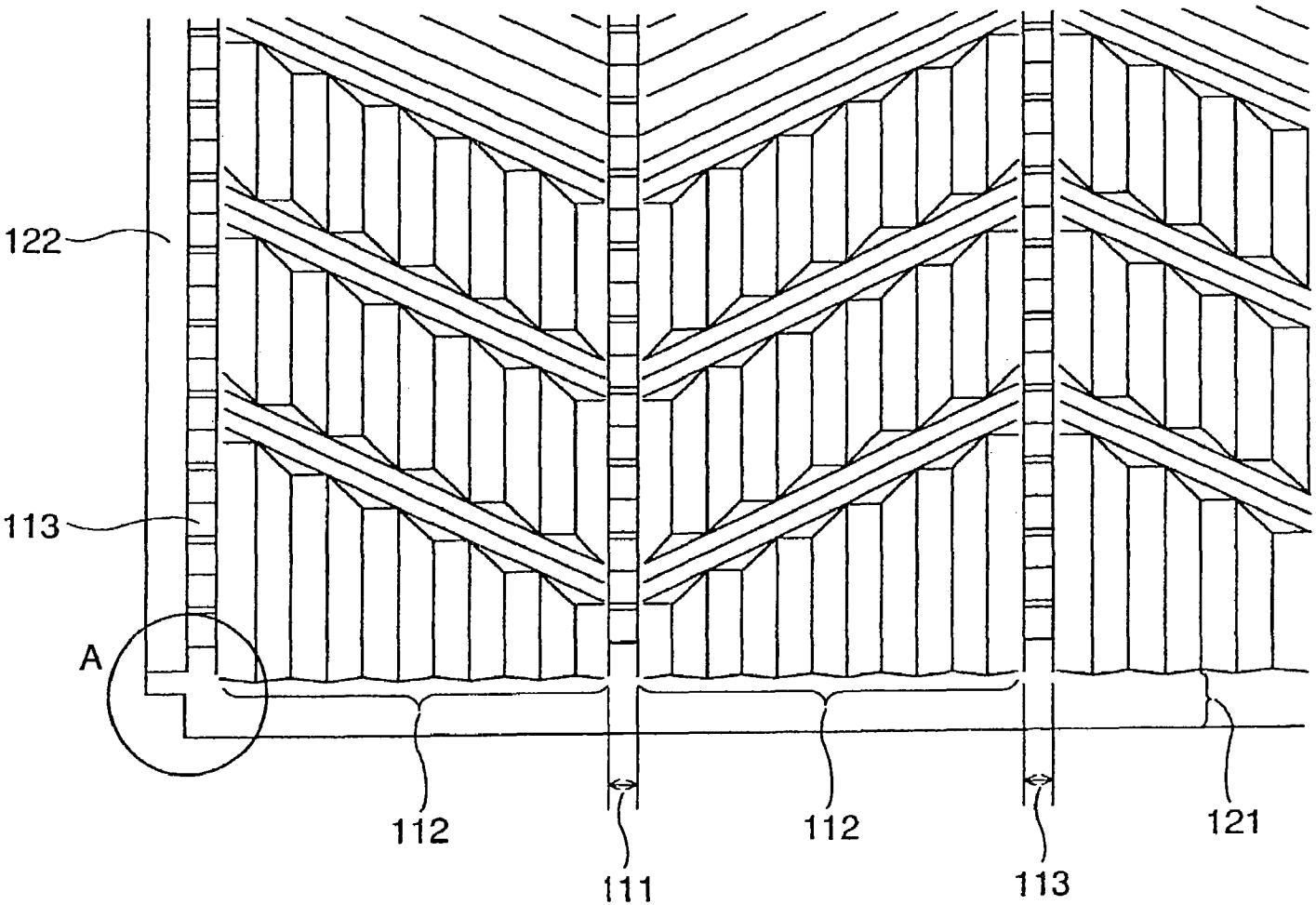
FIG. 6 is a partial enlarged view of the heat transfer member of the embodiment of the present invention.
Figure 7:
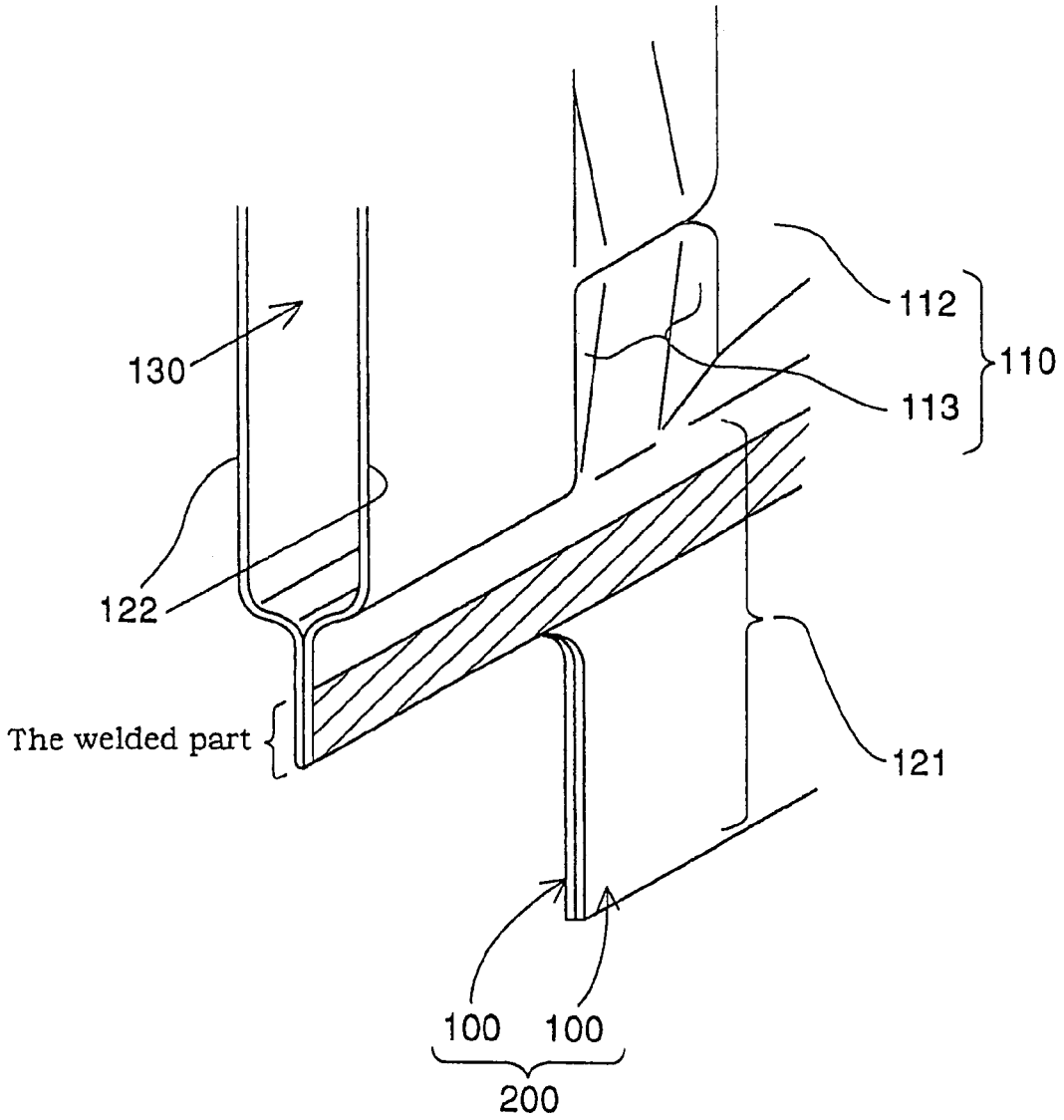
FIG. 7 is an enlarged perspective view of a portion "A" as shown in FIG. 6.
Figure 8:
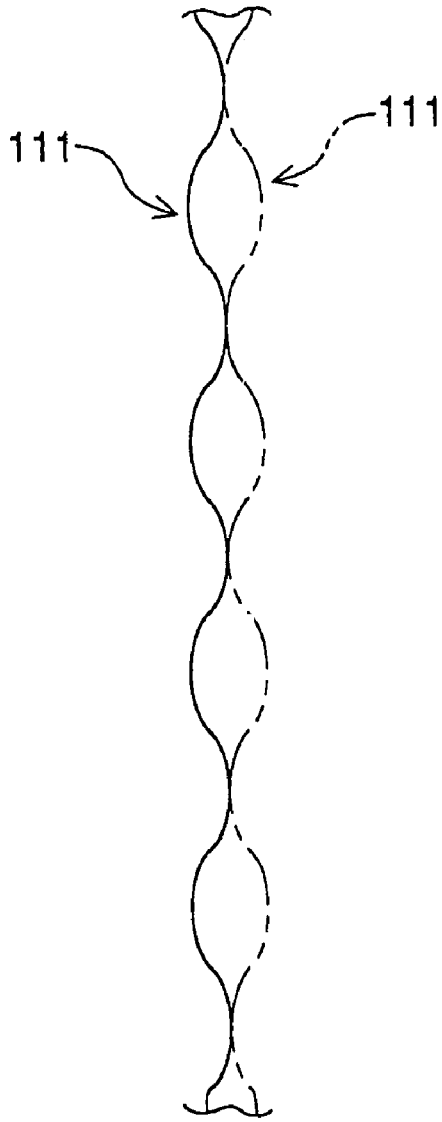
FIG. 8 is a vertical cross-sectional view of an essential component of the central pattern portion of the heat transfer member of the embodiment of the present invention.
Figure 9A:
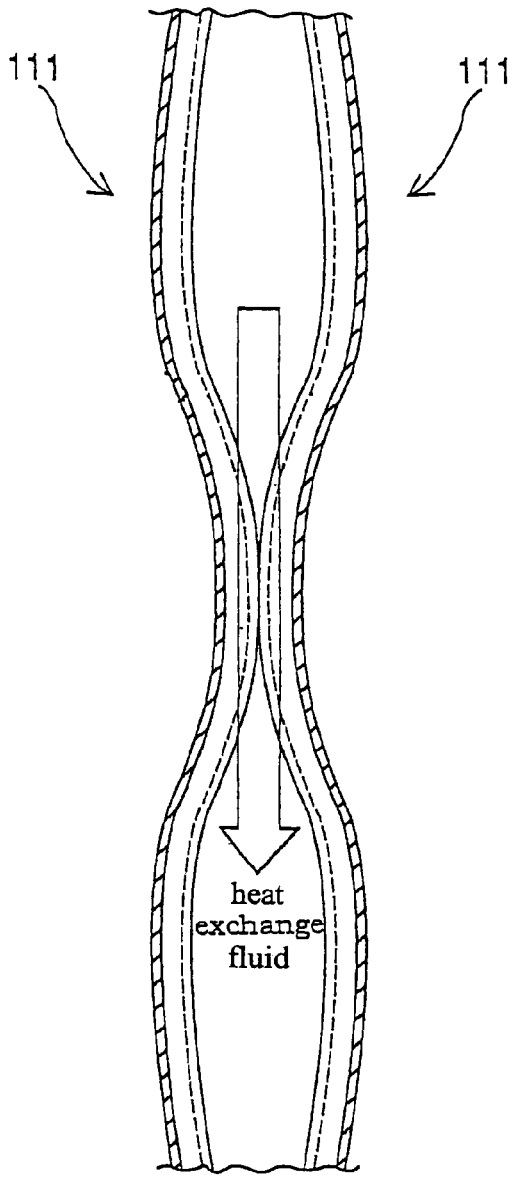
FIG. 9(A) is an enlarged vertical cross-sectional view of the essential component of the central pattern portion of the heat transfer member of the embodiment of the present invention and FIG. 9(B) is an enlarged horizontal cross-sectional view thereof.
Figure 9B:
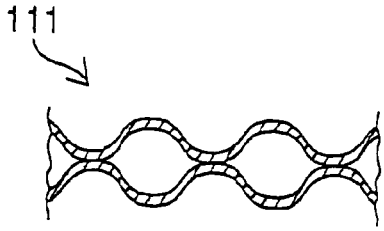

FIG. 1 is a front view illustrating a heat transfer member in accordance with the embodiment of the present invention; FIG. 2 is a descriptive view illustrating a state in which the press-forming step is being carried out in accordance with the embodiment of the present invention; FIG. 3 is a descriptive view of a press-forming operation, which is applied to one end of the material to be worked in accordance with the embodiment of the method of the present invention for manufacturing the heat transfer member; FIG. 4 is a descriptive view of a press-forming operation, which is applied to the intermediate portion of the material to be worked in accordance with the embodiment of the method of the present invention for manufacturing the heat transfer member; FIG. 5 is a descriptive view of a press-forming operation, which is applied to the other end of the material to be worked in accordance with the embodiment of the method of the present invention for manufacturing the heat transfer member; FIG. 6 is a partial enlarged view of the heat transfer member of the embodiment of the present invention; FIG. 7 is an enlarged perspective view of a portion "A" as shown in FIG. 6; FIG. 8 is a vertical cross-sectional view of an essential component of the central pattern portion of the heat transfer member of the embodiment of the present invention; and FIG. 9(A) is an enlarged vertical cross-sectional view of the essential component of the central pattern portion of the heat transfer member of the embodiment of the present invention and FIG. 9(B) is an enlarged horizontal cross-sectional view thereof.

The heat transfer member 100 as shown in FIGS. 1 to 9 in accordance with the embodiment of the present invention has a structure in which press-formed portions are arranged, by feeding material to be worked 50, which is made of a rectangular metallic thin sheet, to a prescribed press-forming device 1 in the single feeding direction, forming a heat transfer face 110 on the central portion of the material to be worked 50 by means of the press-forming device 1 and forming flange portions 120 in the periphery of the heat transfer face 110.

The heat transfer face 110 is a region having a prescribed irregularity, which is optimized to make heat transfer through contact of one surface of the heat transfer face 110 with a high temperature fluid and contact of the other surface thereof with a low temperature fluid. Such a heat transfer face 110 can be obtained by carrying out a plurality of press-forming steps utilizing the press-forming device 1. The heat transfer face 110 has unit regions of a central pattern portion 111, a pair of heat exchanging irregularity pattern portions 112 and boundary pattern portions 113. The central pattern portion 111 has a plurality of projections provided with a prescribed pitch. The heat exchanging irregularity pattern portions 112 are provided on the opposite sides of the central pattern portion so as to symmetrical with respect to the central pattern portion 111. The boundary pattern portions 113 are provided on the respective outer sides of the heat exchanging irregularity pattern portions so as to be adjacent to the respective outer sides thereof. The boundary pattern portion 113 has a plurality of projections provided with the same pitch as the projections of the central pattern portion 111 so as to be in parallel with them.

The above-mentioned heat exchanging irregularity pattern portion 112 is formed on the basis of the known pattern of irregularity, which is provided with a wave-formed cross section having an excellent heat transfer property and with grooves through which condensed water can be discharged rapidly. Description of the irregularity is omitted.

The boundary pattern portion 113 has the same width as the central pattern portion 111. Each of the central pattern portion 111 and the boundary pattern portion 113 has a plurality of recesses or projections, provide a smooth sine curve shaped cross section in a direction perpendicular to the direction of the recesses or projections. The recesses or projections of the smooth sine curve shaped cross section improve formability of the central pattern portion 111 and the boundary pattern portions 113, thus avoiding defects of the products.

The flange portion 120 is composed of flat portions 121 having a prescribed width, which are disposed continuously along two sides of the periphery of a rectangular shape, which are in parallel with the feeding direction, and upward projections 122 continuously extending from the heat transfer face 110 along the other two sides, which are perpendicular to the feeding direction.

The press-forming device 1 for forming the above-described heat transfer member 100 includes a pair of upper and lower main molds 10 for forming the heat transfer face 110 and two pairs of auxiliary molds 20, 30. The main molds 10 form the heat transfer face 110, which has the opposite surfaces to be brought into contact with heat exchange fluids, respectively. The auxiliary molds 20, 30 are disposed on upstream and downstream sides of the main molds 10 in the feeding direction of the material, so as to be exchangeable. Detection devices (not shown) for judging whether or not a prescribed portion to be press-formed of the material to be worked 50 reaches the respective press-forming position are provided in the vicinity of each of the main molds 10 and the auxiliary molds 20, 30.

The main molds 10 have molding faces, which can form the central pattern portion 111, the heat exchanging irregularity pattern portions 112 and the boundary pattern portions 113 of the heat transfer face 110, in addition to the flat portion 121 of the flange portion 120. Especially, the main molds 10 form the pattern of irregularity on the material to be worked in places corresponding to the boundary pattern portions 113 of the heat transfer face 110 at the front and rear zones in the feeding direction, respectively. The patterns of irregularity formed in these places on the material to be worked are identical with each other in shape.

Now, description will be given below of press-forming operation in the method of the embodiment of the present invention for manufacturing the heat transfer member. Such an operation is carried out on the assumption that a defect detection step is carried out previously so that only the material to be worked 50 having no defects is conveyed to the side of the press forming device 1.

The main molds 10 and the auxiliary molds 20, 30 of the press-forming device 1 are previously kept in their initial state in which the respective upper and lower molds are separated from each other. The material to be worked 50 is conveyed by means of a prescribed material feeding unit (not shown) so that the one end of the material to be worked 50 is inserted between the respective upper and lower molds. When the one end of the material to be worked 50 reach a position in which the press-forming step is to be carried out in the press-forming device 1, the feeding operation of the material to be worked 50 is temporarily stopped. The one end of the material to be worked 50 is press-formed by means of the main molds 10 and the auxiliary mold 20 of the press-forming device 1 so that the uniform pressure is applied to the material to be worked 50 to form press-formed portions having a prescribed irregularity in accordance with the respective molds in a reliable manner (see FIG. 3).

The press-formed portion formed by means of the main molds 10 includes the central pattern portion 111, the heat exchanging irregularity pattern portions 112 provided on the opposite sides of the central pattern portion 111 and the boundary pattern portions 113 provided on the respective outer sides of the pair of heat exchanging irregularity pattern portions 112 (see FIG. 2). The boundary pattern portions 113 formed substantially uniformly are placed in the vicinity of the non-pressed portion of the material to be worked 50. Accordingly, degree of drawing of material from the non-pressed portion into the pressed portion in the press formation becomes appropriately constant in a boundary between the press-formed portion and the non-pressed portion, thus reducing residual distortion in the press-formed portion and the non-pressed portion after completion of the press formation.

After completion of the press-forming step applied to the one end of the material to be worked 50, the press-forming device 1 operates to separate all the pairs of upper and lower molds from each other. The feeding operation of the material to be worked 50 is carried out again by means of the material feeding unit so that the material to be worked 50 is subjected to the press-forming step utilizing only the main molds 10. Here, a region of the material to be worked 50, which is to be press-formed newly, includes the boundary pattern portion 113 of the portions as being already press-formed, which boundary pattern portion 113 has been formed in the rear zone in the feeding direction. As a result, such a boundary pattern portion 113 is then press-formed by means of the molds, which are placed in the front zone in the feeding direction.

When the region of the material to be worked 50, which is to be press-formed newly, reaches the press-forming position in the press-forming device 1, the feeding operation of the material to be worked 50 is temporarily stopped. The adjacent portion of the material to be worked 50, to the one end thereof is press-formed by means of the main molds 10 of the press-forming device 1 so that the uniform pressure is applied to the material to be worked 50 to form press-formed portions having a prescribed irregularity in accordance with the respective molds in a reliable manner (see FIG. 4).

Then, the press-forming device 1 causes the respective molds to separate from each other and the feeding operation of the material to be worked 50 is then carried out utilizing the material feeding unit so that the region to be press-formed of the material to be worked 50 reaches the press-forming position. The press-forming device 1 operates to move the upper and lower molds closely to each other so that the region of the material to be worked 50, which is to be press-formed newly, is press-formed. Then, a series of steps for transferring the material to be worked 50 and applying the press forming is repeated by a time of numbers of the regions of the material to be worked 50, which are to be press-formed. Accordingly, a plurality of press-forming steps are applied to the material to be worked 50, which is conveyed by a prescribed length for each of the press-forming steps, utilizing the main molds 10 of the press-forming device 1.

During such a plurality of press-forming steps utilizing the main molds 10, there is repeated the press-forming step, which is applied to the boundary pattern portion 113, which has been press-formed in the rear zone in the feeding direction, utilizing the molds placed in the front zone in the press-forming device 1 in the feeding direction. Accordingly, there is provided a condition in which the press-formed portions are arranged on the material to be worked 50 in the feeding direction of the material to be worked 50 and the single boundary pattern portion 113 is placed in the vicinity of the heat exchanging irregularity pattern portion 112.

After completion of the prescribed number of press-forming steps utilizing the main molds 10, the material to be worked 50 is subjected to the last press-forming steps utilizing the auxiliary molds 30 and the main molds 10, which are placed in the rear zone in the feeding direction of the material to be worked 50. The main molds 10 and the auxiliary molds 30 are kept in their initial state in which the respective upper and lower molds are separated from each other. Then, the material feeding unit conveys the material to be worked 50. When the other end of the material to be worked 50 moves to the press forming position, the feeding operation of the material to be worked 50 is temporarily stopped. The main molds 10 and the auxiliary molds 30 press the other end of the material to be worked 50 so that the uniform pressure is applied to the material to be worked 50 to form press-formed portions having a prescribed irregularity in accordance with the respective molds in a reliable manner. Also in these last press-forming steps, the boundary pattern portion 113 of the portions as being already press-formed, which boundary pattern portion 113 has been formed in the rear zone in the feeding direction, is then press-formed by means of the molds, which are placed in the front zone in the feeding direction.

After completion of the press-forming step utilizing the main molds 10 and the auxiliary molds 30, the press-forming device 1 operates to separate all the molds from each other. The feeding operation of the material to be worked 50 is carried out again by means of the material feeding unit. The material to be worked 50 is conveyed in the feeding direction and then discharged from the upper and lower molds of the press-forming device 1. The material to be worked 50 thus press-formed is then conveyed to a place in which the next steps are to be carried out.

Now, description will be given below of the heat transfer member as manufactured of the embodiment of the present invention. The press-forming steps are applied to the metallic sheet serving as the material to be worked, utilizing the press-forming device 1. The heat transfer member 100, which has been discharged from the press-forming device 1, is placed on the other transfer member 100 as manufactured in the same manner so that the inner surfaces of them face each other and the latter is positioned upside down. These heat transfer members 100 are welded together at the flat portions of the flange portion 120 into a united body serving as a set of heat exchanger unit 200. An essential component of a heat exchanger is composed of a plural set of heat exchanger units 200 thus obtained.

When the heat transfer member 100 is placed on the other transfer member 100 so that the inner surfaces of them face each other and the latter is positioned upside down, the flat portions 121 of these two heat transfer members 100 come into close contact with each other and the central pattern portions 111 and the boundary pattern portions 113 of these two heat transfer members 100 come into contact with each other so that the prescribed gap is formed between the two heat transfer members 100 (see FIG. 8). As a result, there are formed an internal cavity, which is surrounded by the flange portions 120 and the respective heat transfer faces 110, as well as a passage 130 formed by the projections 122, which communicates with the internal cavity (see FIG. 7). The position of the passage 130 can easily be set by determination of the position of the projection 122.

The projections of the irregularities of the central pattern portions 111 and the boundary pattern portions 113, which come into contact with each other, form the gaps in a place corresponding to the recesses thereof so that heat exchange fluid can flow through these gaps (see FIG. 9). The contact areas between the central pattern portions 111 and the boundary pattern portions 113 can be minimized so that heat exchange fluids can flow smoothly along the opposite surfaces of the heat transfer face of the heat transfer member 100, thus enhancing the heat exchange effectiveness.

The two heat transfer members 100 are assembled into the heat exchanger unit 200 so that heat exchange fluid can flow in and out of the internal cavity through the passage 130 formed by the projections 122. Flowing fluid to be heat-exchanged on the outer surface of the heat transfer member 200 provides a heat exchange operation. When the heat exchange fluid in gaseous phase flows in the internal cavity of the heat exchanger unit 200 and the other heat exchange fluid having a sufficiently low temperature flows outside the heat exchanger unit 200, the heat exchange fluid in gaseous phase in the internal cavity is cooled to be condensed. As a result, condensed water flow down along the heat transfer face 110, thus effectively utilizing the heat transfer unit 200 as the condenser. In such a case, the condensed water is collected from the heat exchanging irregularity pattern portions 112 of the heat transfer face 110 into the central pattern portion 111 and the boundary pattern portion 113 so as to fall down rapidly through the gaps in the irregularities of the central pattern portion 111 and the boundary pattern portion 113, thus discharging the condensed water in an appropriate manner without causing buildup and ensuring the sufficient heat exchange effectiveness.

When a plurality of sets of the heat exchanger units 200, each of which is formed into the united body, are placed one upon another to constitute an essential component of a heat exchanger, the projections of the central pattern portion 111 and the boundary pattern portion 113, and the projections 122 of the flange portion 120 of the heat transfer face 110 come into contact with the corresponding projections of the other heat transfer face 110, thus maintaining the appropriate gap between the two heat transfer faces 110.

According to the heat transfer member of the embodiment of the present invention, there are formed the central pattern portion 111 having the projections, the heat exchanging irregularity pattern portions 112 provided on the opposite sides of the central pattern portion 111 so as to be symmetrical with respect to the central pattern portion 111, and the boundary pattern portions 113 having the projections in the same manner as the central pattern portion 111 so that these portions form the single heat transfer face 110. When the heat transfer member 100 is placed on the other heat transfer member 100 so that the inner surfaces of them face each other and the latter is positioned upside down, the projections of the central pattern portion 111 and the projections of the boundary pattern portion 113 of the one heat transfer member come into close contact with those of the other heat transfer member, respectively. It is therefore possible to maintain a constant distance between the heat transfer members 100, thus providing a uniform heat exchanging property, even when there is a large difference in pressure between the heat transfer fluids, which flow on the opposite surfaces of the heat transfer face 110.

According to the method of the present invention for manufacturing the heat transfer member, during a plurality of press-forming steps applied to the material to be worked 50 utilizing the press-forming device 1, the boundary pattern portion 113 of the portions as being already press-formed, which boundary pattern portion 113 has been formed in the rear zone in the feeding direction, is press-formed again by means of the molds, which are placed in the front zone in the feeding direction. Accordingly, the boundary pattern portion 113 as press-formed is held to minimize drawing of material from the portion as press-formed into the portion to be press-formed newly, thus reducing occurrence of distortion in the press-formed portion due to the new press formation and reducing residual distortion in the press-formed portion and the non-pressed portion after completion of the press formation. Abnormal deformation of the heat transfer member 100 as finally obtained can therefore be prevented.

In the above-described embodiment of the heat transfer member of the present invention, a plurality of sets of the press-formed portions formed by means of the press-forming device 1 in the prescribed arrangement forms the single heat transfer face 110. The present invention is not limited only to such an embodiment. There may be provided a single set of press-formed portions, which includes the central pattern portion 111, the heat exchanging irregularity pattern portions 112 provided on the opposite sides of the central pattern portion 111 and the boundary pattern portions 113 provided on the respective outer sides of the pair of heat exchanging irregularity pattern portions 112. Such a structure makes it possible to provide a smaller-sized heat transfer member 100, coping with a compact heat exchanger.

Figure 10:
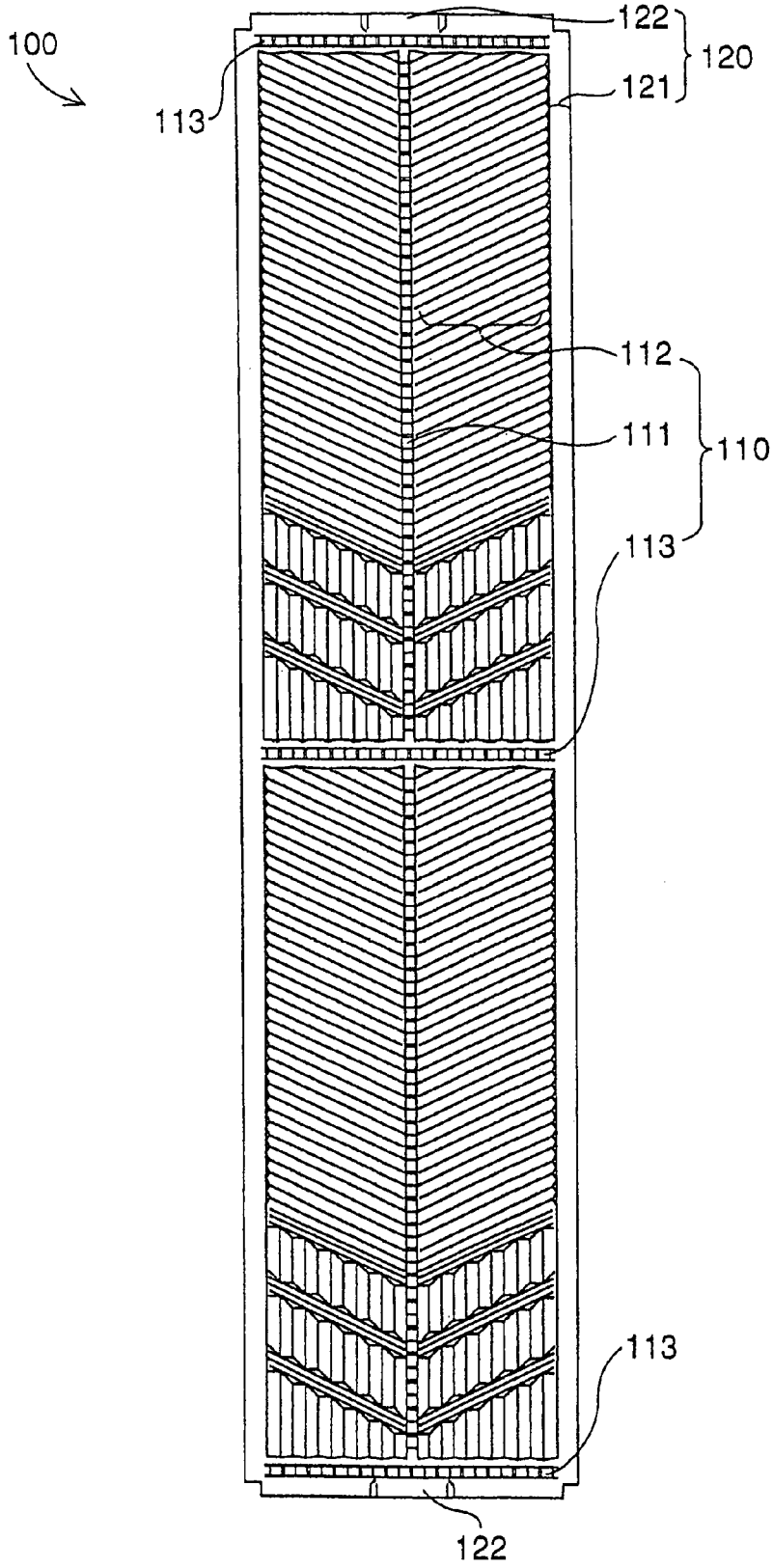
FIG. 10 is a front view of the heat transfer member of the other embodiment of the present invention.

In the above-described embodiment of the heat transfer member of the present invention, the press-formed portions are formed in the prescribed arrangement by means of the press-forming device 1 so that the patterns are arranged in the horizontal direction. The present invention is not limited only to such an embodiment. The molding faces of the press-forming device 1 may be changed so that the central pattern portion 111 and the heat exchanging irregularity pattern portions 112 are formed on the material to be worked 50 in a parallel direction to the feeding direction of the material to be worked 50 and that the patterns of irregularity having the same shape are formed in correspondence to the above-mentioned boundary pattern portions 113, in the front and rear zones in the feeding direction, in an equal positional relationship relative to the central position in a perpendicular direction to the feeding direction of the material to be worked. In such a case, there is provided the heat transfer face 110 in which the boundary pattern portion 113 is held between the upper set of central pattern portion 111 and the heat exchanging irregularity pattern portion 112 and the lower set of central pattern portion 111 and the heat exchanging irregularity pattern portion 112 as shown in FIG. 10. When the heat transfer member 100 is placed on the other heat transfer member 100 so that the inner surfaces of them face each other and the latter is positioned upside down, the projections of the central pattern portion 111 and the projections of the boundary pattern portion 113 of the one heat transfer member come into close contact with those of the other heat transfer member, respectively. It is therefore possible to maintain a constant distance between the heat transfer member 100. Even when the respective ends of the central pattern portion 111 and the heat exchanging irregularity pattern portion 112 has a non-uniform pattern in the horizontal direction of the heat transfer face 110, the boundary pattern portions 113 formed substantially uniformly are placed in the vicinity of such a non-uniform pattern, the boundary pattern portion 113, which is located between the central pattern portion 111 and the heat exchanging irregularity pattern portion 112 is subjected to the dual press forming so that the boundary pattern portion 113 is held during the second press forming to prevent drawing of material from the portion as press-formed into the portion to be press-formed newly. It is therefore possible to reducing residual distortion after completion of the press formation, thus preventing abnormal deformation of the heat transfer member 100.

In the above-described embodiment of the heat transfer member of the present invention, the boundary pattern portion 113 and the central pattern portion 111 has the same width. The present invention is not limited only to such an embodiment. The patterns of irregularity, which are placed in the front and rear zones in the feeding direction of the molding face of the main molds of the press-forming device 1 so as to correspond to the boundary pattern portion 113 of the heat transfer member 100, may be reduced to half of the central pattern portion 111. In such a case, the feeding length of the material to be worked is changed so that only a portion, which has not as yet been subjected to the press forming, is press-formed newly, without applying the dual press-forming. The width of the boundary pattern portion 113, which is placed between the heat exchanging irregularity pattern portions 112 becomes equal to the central pattern portion 111. The width of the boundary pattern portion 113, which is placed the outermost side of the heat transfer face 110, is half of the central pattern portion 111.

In the above-described embodiment of the heat transfer member of the present invention, the central pattern portion 111 and the boundary pattern portion 113 have a smooth sine wave-shaped cross section in a direction perpendicular to the recesses or projections. Each of the heat exchanging irregularity pattern portions 112 of the heat transfer face 110 may have grooves or projections so as to form a wave-formed cross section. Such a structure improves formability of the heat exchanging irregularity pattern portion 112, thus avoiding defects of the products.

What is claimed is:

1. A heat transfer member for a heat exchanger, which is press-formed of a metallic thin sheet material into a prescribed shape by means of molds of a press forming device so that said heat transfer member has on at least one portion thereof a heat transfer face having opposite surfaces, which are to be brought into contact with heat exchange fluids, respectively, wherein:

said heat transfer face comprises at least one set of irregularity patterns arranged in a row, each of said at least one set of irregularity patterns comprising (i) a central pattern portion having a plurality of recesses or projections provided with a prescribed pitch and a central pattern width, said central pattern portion having two pairs of opposite sides, (ii) a pair of heat exchanging irregularity pattern portions provided on one of said two pairs of opposite sides of said central pattern portion so as to be symmetrical with respect to said central pattern portion, said pair of heat exchanging irregularity pattern portions and said central pattern forming a pair of opposite connection sides extending along an other of said two pairs of opposite sides of said central pattern portion, and (iii) at least one boundary pattern portion provided on at least one of said pair of opposite connection sides, said at least one boundary pattern portion having a prescribed boundary pattern width and a plurality of recesses or projections with a prescribed pitch so as to be perpendicular to said plurality of recesses or projections of said central pattern portion, the prescribed boundary pattern width being substantially equal to the central pattern width.

2. The heat transfer member as claimed in claim 1, wherein:

said boundary pattern portion continues in a form of grooves or projections in a direction perpendicular to a direction of said plurality of recesses or projections thereof so as to form a plurality of rows of irregularities, providing a smooth wave-shaped cross section.

3. The heat transfer member as claimed in claim 1, wherein:

said central pattern portion or said boundary pattern portion continues in a form of grooves or projections in a direction of said plurality of recesses or projections thereof so as to form a plurality of rows of irregularities, providing a smooth wave-shaped cross section.

* * * * *